United States Patent [19]

Hattori et al.

[11] Patent Number: 4,609,299

[45] Date of Patent: Sep. 2, 1986

[54] PRINTING APPARATUS

[75] Inventors: Shigenori Hattori; Naohisa Kinoshita, both of Aichi, Japan

[73] Assignee: Brother Kogyo Kabushiki Kaisha, Aichi, Japan

[21] Appl. No.: 661,446

[22] Filed: Oct. 16, 1984

[30] Foreign Application Priority Data

Oct. 20, 1983 [JP] Japan ..... 58-196908
Oct. 20, 1983 [JP] Japan ..... 58-196909

[51] Int. Cl.[4] ..... B41J 33/04

[52] U.S. Cl. ..... 400/229; 400/234; 400/236.2; 400/120

[58] Field of Search ..... 400/227, 229, 234, 236, 400/236.2, 120

[56] References Cited

U.S. PATENT DOCUMENTS 3,190,430 6/1965 McGrath ..... 400/227
4,373,824 2/1983 Olsen ..... 400/234
4,378,566 3/1983 Tsukamura ..... 400/120 X
4,468,139 8/1984 Hattori ..... 400/234 X

FOREIGN PATENT DOCUMENTS 0101887 8/1981 Japan ..... 400/236.2
0090978 5/1983 Japan ..... 400/120

*Primary Examiner*—Edgar S. Burr
*Assistant Examiner*—John A. Weresh
*Attorney, Agent, or Firm*—Finnegan, Henderson, Farabow, Garrett & Dunner

[57] ABSTRACT

A printing apparatus includes a driving gear on a carriage rotated in accordance with the movement of the carriage, a spool shaft rotatable only in one direction for rotating a ribbon spool of a ribbon cassette, and a rotation transmitting mechanism having first and second releasing members provided between the driving gear and the spool shaft for operatively interlinking the driving gear to the spool shaft to rotate the spool shaft in the one direction in accordance with the movement of the carriage in the forward direction. The first releasing member is driven by a print head and releases an operational interlink between the driving gear and the spool shaft when the print head is disposed at a non-printing position. The second releasing member releases the operational interlink in accordance with the movement of the carriage in the reverse direction.

9 Claims, 7 Drawing Figures

PRINTING APPARATUS

FIELD OF THE INVENTION

The present invention relates to a printing apparatus having a print head which is mounted on a movable carriage, is movable between a printing position and a non-printing position and is used with a ribbon cassette detachably mounted on the carriage.

BACKGROUND OF THE INVENTION

In conventional printing devices capable of performing printing operations in the reverse direction after completion of printing operations in the forward direction, undesirable noise is likely to be generated when the carriage is moved in reverse. Further, in a printing apparatus having a ribbon that is wound on a take-up reel by the movement of the carriage for each printing operation of one line, when the print head is moved from a printing position to a non-printing position, the used part of the print ribbon is not completely wound up due to slack in the print ribbon caused by the ribbon winding mechanism. Thus, the used portion of the print ribbon is likely to be unintentionally reused by the print head, thus causing poor print quality.

OBJECTS AND SUMMARY OF THE PRESENT INVENTION

An object of the present invention is a printing apparatus capable of performing printing operations in the forward direction by using a thermal print head and a thermal transferable print ribbon and in the forward and reverse directions by using thermal sensitive printing paper and the thermal print head without using the thermal transferable print ribbon.

Another object of the present invention is a printing apparatus that does not generate noise when performing printing operations as the carriage is moved in the reverse direction.

A further object of the present invention is a printing apparatus wherein the shifting of a print head from a printing position to a non-printing position causes the used portion of the print ribbon to be wound up and prevents it from being reused by the print head.

Still another object of the present invention is a printing apparatus that produces clear print images.

These and other objects are attained by a printing apparatus comprising a driving gear mounted on a movable carriage so as to be rotated in accordance with the movement of the carriage, a spool shaft rotatable only in one direction for rotating a ribbon spool of a ribbon cassette, and a rotation transmitting mechanism having first and second releasing members provided between the driving gear and the spool shaft for operatively interlinking the driving gear to the spool shaft to rotate the spool shaft in a first direction in accordance with the movement of the carriage in the forward direction, the first releasing member being driven by a print head to release an operational interconnection between the driving gear and the spool shaft when the print head is disposed in a non-printing position, and the second releasing member for releasing the operational interconnection between the driving gear and the spool shaft in accordance with movement of the carriage in the reverse direction.

A driven gear is provided for rotating the spool shaft and a rotation transmission mechanism interlinks the driving gear and the driven gear such that the movement of the print head to a non-printing position interlinks the drive gear and the driven gear and rotates the driven gear through a given angle to wind the ribbon.

BRIEF DESCRIPTION OF THE DRAWINGS

Other objects and advantages of the present invention will become clear from the following description of the present invention when considered with reference to the accompanying drawing, in which.

DESCRIPTION OF THE PREFERRED EMBODIMENT

Figure 1:
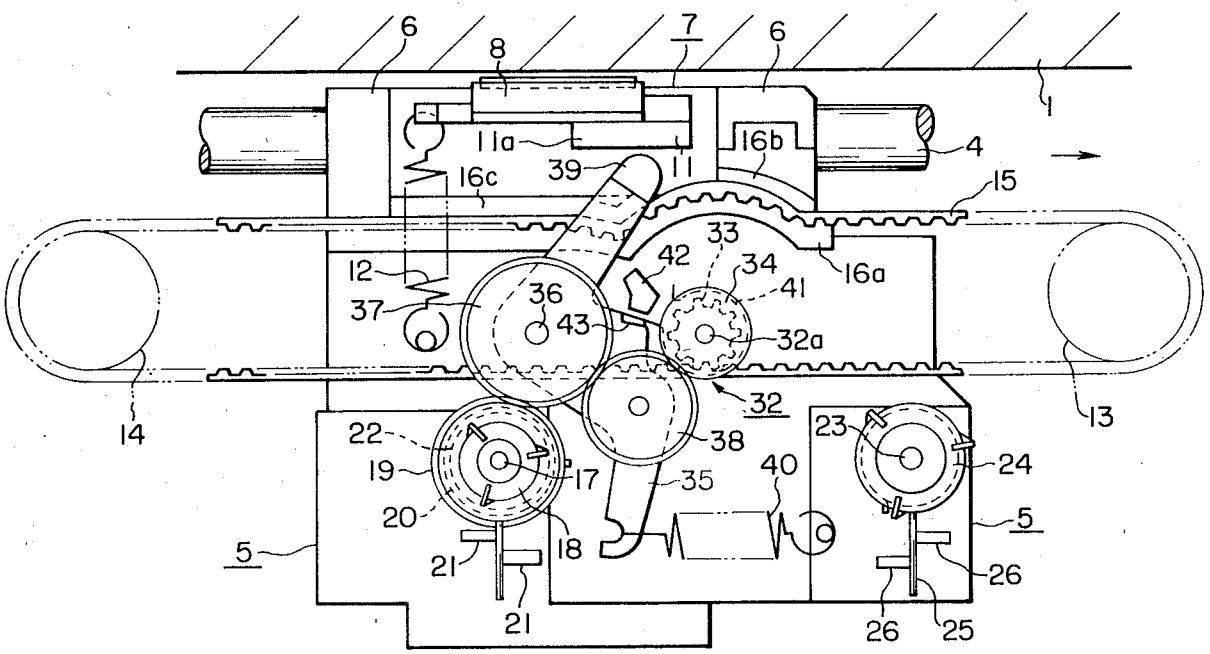
FIG. 1 is a plan view of an embodiment of a thermal printer according to the present invention.

A typical embodiment of a printing apparatus according to the present invention, which is applied to a thermal printer, will be explained with reference to the drawings. As shown in FIGS. 1 to 5, a longitudinally extending platen 1 is provided on a frame (not shown) of the printer, and a paper guide member 2 and a paper feeding roller 3 are disposed beneath the platen 1 in the frame. A carriage body 5 is movably supported by a supporting shaft 4 which extends in parallel beneath the platen 1. Journal members 6, provided at opposite ends of the carriage body 5, are mounted for movement along the shaft 4. A rear bottom surface of the carriage body 5 is supported on a guide member (not shown). A bottom portion of a head carriage 7 is rotatably supported by the shaft 4 between the journal portions 6. A print head 8 is provided on an upper surface of the head carriage 7 in opposition to the platen 1.

Figure 2:
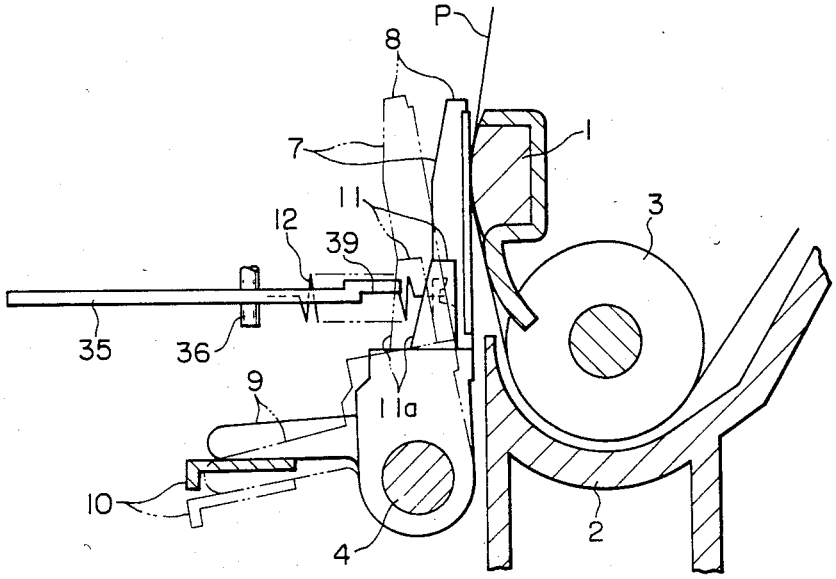
FIG. 2 is a cross section of FIG. 1 showing a main part of the embodiment of FIG. 1.

A projecting tab 11 having a slant surface 11*a* inclined from a top portion of the head 8 toward a rear bottom portion thereof is provided at a bottom portion of the print head 8. As shown in FIG. 2, a spring 12 applies tension to the head carriage 7 and the print head 8 to rotate them counterclockwise and away from the paper P.

A release lever 10 is disposed in the frame so as to oppose a bottom surface of a projection tab 9 which is provided at a rear side surface of the head carriage 7, as shown in FIG. 2. The projection tab 9 is urged in contact with the release lever 10 under the bias force applied to the carriage 7 by the tension spring 12. When the release lever 10 is moved to a position shown by the solid line in FIG. 2, the print head 8 together with the head carriage 7 are held at a printing position as shown by the solid line in FIG. 2. On the other hand, when the release lever 10 is moved to a position shown by the chain line in FIG. 2, the print head 8, together with the head carriage 7, is disposed at a non-printing position as shown by the chain line in FIG. 2.

At the side portions of the frame, there are provided an idle pulley 14 and a driving pulley 13 which is rotated forwardly and reversely by a driving motor (not shown). An endless toothed driving belt 15 is wound around both of the pulleys 13 and 14. A part of the driving belt 15 is engaged with a toothed wall 16*a* which protrudes from an upper surface of the carriage body 5, thereby sandwiching a part of the belt 15 between the toothed wall 16*a* and plural holding walls 16*b*, 16*c*, as shown in FIG. 1.

Figure 5:
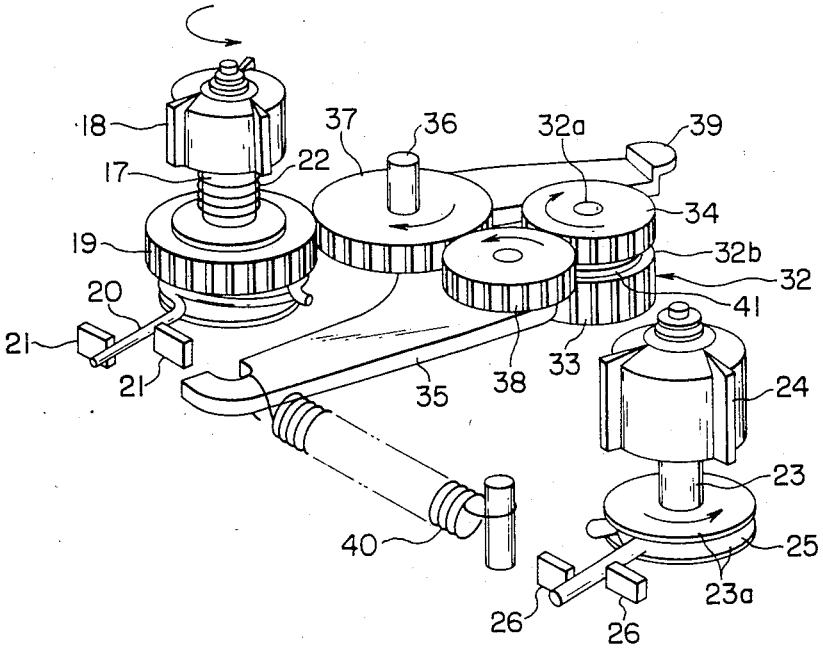
FIG. 5 is a perspective view showing a main part of the embodiment of FIG. 1.
Figure 3:
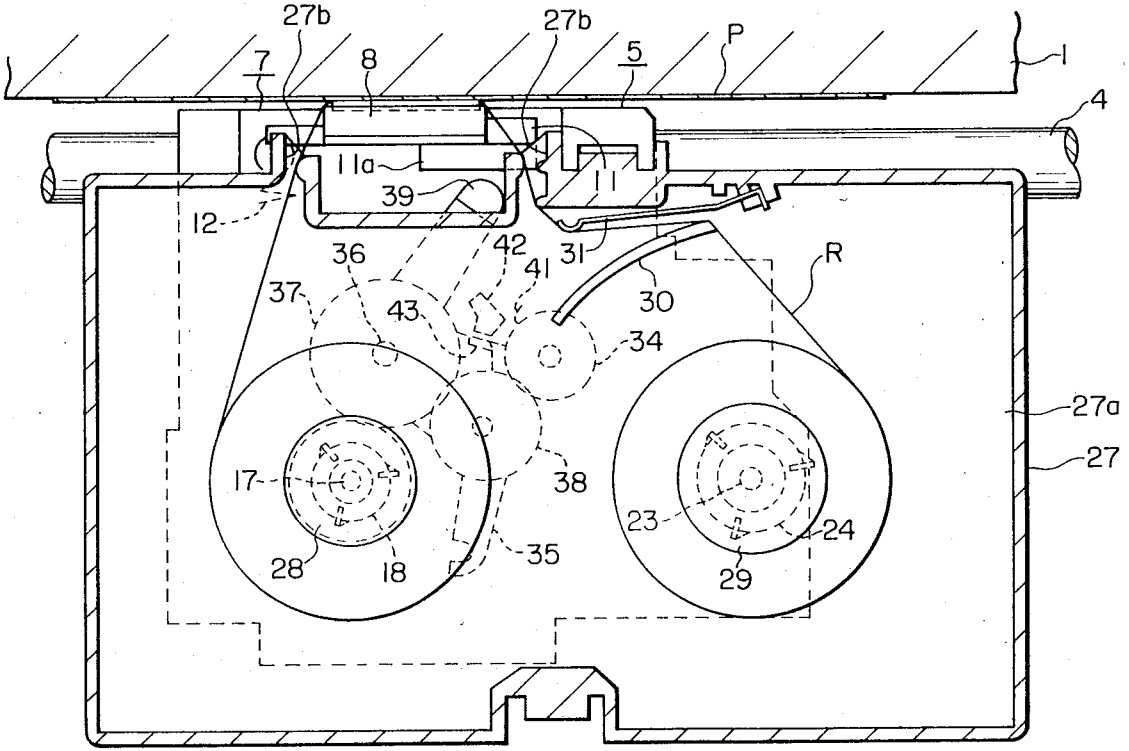
FIG. 3 is a cross section of FIG. 1 showing a ribbon cassette in the printing position.

As shown in FIGS. 1, 3, and 5, a spool shaft 17 for winding a ribbon is rotatably mounted on the upper surface of the carriage body 5 in front of the driving belt 15. An interlinking cylindrical member 18 is fixed on a top end of the spool shaft 17 as shown in FIG. 5. At a bottom portion of the spool shaft 17, a driven gear 19 is rotatably supported by the shaft 17.

A coil spring 22 is wound around the spool shaft 17 between the interlinking cylindrical member 18 and the driven gear 19. Further, a rotation transmitting disc (not shown) is fixedly mounted to the shaft 17 beneath the driven gear 19. The driven gear 19 is pressed into contact with the rotation transmitting disc by the coil spring 22 so that the gear 19 and the disc rotate together.

A clutch spring 20 is wound around the bottom portion of the spool shaft 17 between the driven gear 19 and the upper surface of the carriage body 5 in a manner such that an outer end thereof is fixedly held by a pair of fixing tabs 21 provided on the carriage body 5. The spool shaft 17, the interlinking cylindrical member 18 and the driven gear 19 are capable of rotating only in a direction to wind the ribbon, i.e., the direction shown by an arrow in FIG. 5, due to the clutch spring 20.

A spool shaft 23 for feeding the ribbon is rotatably provided on the carriage body 5 at the right side of the spool shaft 17 for supplying the ribbon. An interlinking cylindrical member 24 is fixed on a top end of the spool shaft 23. A clutch spring 25, having an elastic force smaller than that of the clutch spring 20, is wound around the spool shaft 23 at the bottom portion of the spool shaft 23 between a pair of discs 23*a* which are rotated with the shaft 23. An outer end of the clutch spring 25 is fixedly held by a pair of fixing tabs 26 provided on the carriage body 5. The spring 25 is wound around the shaft 23 in a manner such that the spool shaft 23 is supplied with a rotational resistance by the spring 25 when the spool shaft 23 is rotated to feed the ribbon, i.e., the direction shown by the arrow in FIG. 5.

A ribbon cassette 27 (FIG. 4) is detachably mounted on the carriage body 5. The cassette 27 receives on a bottom wall 27*a* a ribbon spool 28 for winding the ribbon which is rotatably fitted to the interlinking cylindrical member 18 mounted to the spool shaft 17 for winding the ribbon and also a spool 29 for feeding ribbon which is rotatably fitted to the spool shaft 23.

A pair of ribbon passing openings 27*b* are provided in an edge of the ribbon cassette 27 which open at both sides of the print head 8. A guide wall 30 having an arc-like configuration is formed so as to project from the bottom wall 27*a* of the ribbon cassette 27 between the passing opening 27*b* disposed at the right hand side in FIG. 3 and the ribbon spool 29. A leaf spring 31, mounted on an inside wall of the ribbon cassette 27, applies tension to the ribbon R as it passes along the guide wall 30. The thermal transferable ribbon R wound around the ribbon spool 29 is passed into a space between the guide wall 30 and the leaf spring 31, is fed to a position in front of the print head 8 through the ribbon passing opening 27*b* at the right hand side, and is wound around the ribbon spool 28 through the ribbon passing opening 27*b* at the left hand side.

A driving member 32 is provided on the carriage body 5 between the spool shafts 17 and 23 and is rotatably mounted on a shaft 32*a*. A driving gear 33 is rotatably mounted on the shaft 32*a* beneath the driving member 32 so as to engage an inner surface of the driving belt 15. When the head carriage 7 is moved toward the right hand side in FIG. 1 together with the carriage body 5 in accordance with the rotation of the driving belt 15, the driving gear 33 engaged with the inner surface of the belt 15 is rotated clockwise. On the other hand, when the head carriage 7 is moved toward the left hand side in FIG. 1 together with the carriage body 5, the driving gear 33 is rotated counterclockwise.

A first intermediate gear 34 is rotatably mounted on the shaft 32*a* above the driving member 32. A release lever 35, acting as a first release means, is rotatably supported by a shaft 36 which protrudes from the carriage body 5 between the drive gear 33 and the driven gear 19 so that almost a center portion of the release lever is rotatably supported by the shaft 36. A second intermediate gear 37 is rotatably mounted on the shaft 36 above the release lever 35 so as to engage the driven gear 19. Further, a third intermediate gear 38 is rotatably mounted on the release lever 35 so as to engage the second intermediate gear 37 and to be selectively engageable from the first intermediate gear 34 in accordance with the rotational movement of the release lever 35.

An engaging member 39 is formed at a rear end of the release lever 35. The member 39 is capable of engaging the slant surface 11*a* of the projection tab 11 formed on the print head 8. A tension spring 40 applies tension to the release lever 35 so as to rotate it counterclockwise about the shaft 36 in FIG. 1. A circular coiled spring 41, that acts as a second release means, is disposed within a recess 32*b* formed in the outer circumference of the driving means 32 between the driving gear 33 and the first intermediate gear 34. A linear outer end of the coiled spring 41 is opposed to a fixed tab 42 projecting from the carriage body 5 and tab 43 protruding from a top surface of the release lever 35.

When mounting the ribbon cassette 27 on the carriage body 5, the release lever 10 is disposed at a position shown by the chain line in FIG. 2. Thus, the print head 8 on the head carriage 7 in held at the non-printing position shown by the chain line in FIG. 2 by the tension of the spring 12. In this state, the slant surface 11*a* of the print head 8 is engaged with the engaging member 39 of the release lever 35, thereby displacing the release lever 35 to the position shown in FIG. 4 against the tension stress of the tension spring 40. As a result, the third intermediate gear 38 is displaced to a position disengaged from the first intermediate gear 34. In this state, the ribbon cassette 27 may be mounted on the carriage body 5, and the ribbon spool 28 for winding the ribbon (ribbon winding spool) and the ribbon spool 29 for feeding the ribbon (ribbon feeding spool) may be fitted onto the spool shaft 17 for winding the ribbon (ribbon winding spool shaft) and the spool shaft 23 for feeding the ribbon (ribbon feeding spool shaft), respectively. Next, the part of the thermal transferable ribbon R exposed out of the ribbon cassette 27 through the ribbon passing openings 27 is disposed in front of the print head 8. In this manner, the ribbon cassette 27 is mounted on the carriage body.

When a given character key is pushed down, the release lever 10 is automatically shifted upward to a position shown by the solid line in FIG. 2 by a control apparatus (not shown). Thus, the head carriage 7, as well as the print head 8, are displaced to the printing position shown by the solid line in FIG. 2 against the tension stress of the tension spring 12. The print head 8 is held at the printing position by the engagement of the projection tab 9 and the release lever 10. This displacement of the print head 8 enables the release lever 35 to be rotated counterclockwise.

The release lever 35 is rotationally shifted to the position shown in FIG. 3 by the force of the tension spring 40, so that the third intermediate gear 38 on the release lever 35 is engaged with the first intermediate gear 34. The driving gear 33 is operatively interlinked with the driven gear 19 through the first intermediate gear 34, the third intermediate gear 38, and the second intermediate gear 37. Further, by the rotational movement of the print head 8, the thermal transferable ribbon R is slightly pulled out of the ribbon feeding spool 29 against the stress applied thereto from the spring 25 shown in FIG. 5 and the leaf spring 31 shown in FIG. 3. This causes a part of the exposed ribbon R to be pressed onto normal printing paper P disposed on the platen 1.

In this state, if the print head 8 is operated by the control apparatus, characters are printed on the printing paper P. If the driving pulley 13 is rotated by a predetermined angle clockwise in FIG. 1, the carriage body 5, head carriage 7, and print head 8 are also moved toward the right in FIG. 1. The driving gear 33 engaged with the driving belt 15 is rotated by a given angle clockwise in FIG. 1. In this case, an outer end of the coiled spring 41 is engaged with the fixed tab 42 on the carriage body 5, so that the coiled spring 41 slips along the recess **32*b* of the driving member 32**.

With the rotation of the driving gear 33, the driven gear 19 is rotated counterclockwise by a predetermined angle as shown in FIG. 3, i.e., in the direction for winding the ribbon, through the first, the second, and the third intermediate gears 34, 37, and 38, so that the spool shaft, the interlinking cylindrical member 18, and the ribbon winding spool 28 are rotated together with the driven gear 19. Thus, the used portion of the thermal transferable ribbon R exposed out of the cassette 27 is wound up by the ribbon winding spool 28 against the stress of the spring 25 and the leaf spring 31, so that unused thermal transferable ribbon R is fed out of the ribbon feeding spool 29 for printing on the next character of printing paper.

If a carriage return button is pushed after completing printing of one line, the release lever 10 is automatically moved by the control apparatus to a position shown by the chain line in FIG. 2 and thereafter, the carriage body 5 is shifted toward the hand side to a print start position. The head carriage 7 is displaced together with the print head 8 to the non-printing position shown in FIG. 2 by the force of the tension spring 12.

Figure 4:
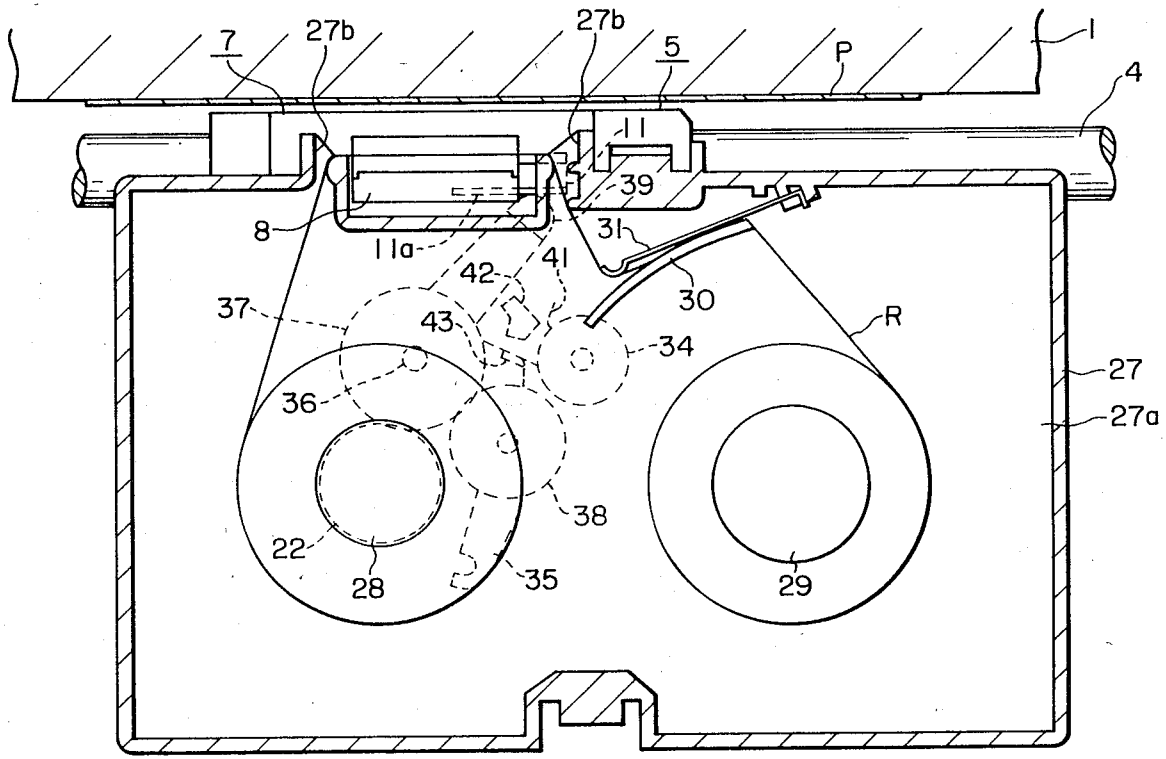
FIG. 4 is a cross section of FIG. 1 showing a ribbon cassette in a non-printing position.

At this time the thermal transferable ribbon R is loosened to cause slack therein, so that the leaf spring 31 is bent toward the guide wall 30 by the counteracting force thereof and is displaced to the position shown in FIG. 4 thereby eliminating slack in the ribbon R. In this embodiment, the biasing stress of the unidirectional clutch spring 20 is set to be larger than that of the spring 25, so that the ribbon R having once wound around the ribbon winding spool 28 can not be unwound but the ribbon R can always be fed out of the ribbon feeding spool 29. Further, by the displacement of the print head 8 to a position shown by the chain line in FIG. 2, the slant surface **11*a* of the print head 8 is engaged with the engaging portion 39 of the release lever 35 thereby rotating the release lever 35 clockwise in FIG. 3 to separate the third intermediate gear 38 from the first intermediate gear 34. Thus, the driven gear 19 is disengaged from the driving gear 33**.

In this state, if the driving pulley is rotated counterclockwise in FIG. 1, the carriage body 5 is moved toward the left in FIG. 1. Thus, the driving gear 33 engaged with the driving belt 15 is rotated counterclockwise in accordance with the rotation of the belt 15. However, the rotational operation of the driving gear 33 is not transmitted to the driven gear 19, so that the ribbon winding spool 28 is not rotated to wind the ribbon during a carriage return.

Next, explanation will be made for a case where characters are printed on the thermal sensitive printing paper P in a bidirectional printing manner.

In order to perform this operation, in a state where the print head 8 is disposed at a non-printing position shown by the chain line in FIG. 2, the ribbon cassette 27 is removed from the spool shafts 17 and 23 on the carriage body 5 and the print head 8 is disposed at a printing position shown by the solid line in FIG. 2. In this state, the release lever 35 is disposed at the position shown in FIG. 3, the third intermediate gear 38 on the release lever 35 is engaged with the first intermediate gear 34, and the driving gear 33 is operatively interlinked with the driven gear 19 through the first, second, and third intermediate gears 34, 37, and 38.

If the print head 38 is operated in this state, characters are printed on the thermal sensitive printing paper P and then the carriage body 5 is shifted toward the right in FIG. 3 by a predetermined distance. When the carriage body 5 is shifted, the driving gear 33 is rotated clockwise in FIG. 1. The rotational operation of the driving gear 33 is transmitted to the spool shaft 17 through the first, second and third intermediate gears 34, 37, and 38 and the driven gear 19. Thus, the spool shaft 17 is allowed to rotate in a direction for winding the ribbon due to the biasing force of the unidirectional clutch spring 20.

On the other hand, when the carriage body 5 is shifted toward the left (i.e., in the reverse direction) in FIG. 3, the driving gear 33 is rotated counterclockwise in FIG. 1. During the rotation of the driving gear 33, the outer end of the coiled spring 41 on the driving member 32 is engaged with the engaging tab 43 of the release lever 35 and so the release lever 35 is held at a position shown in FIG. 4 against the force of the tension spring 40 due to the engagement of the engaging tab 43 and the outer end of the coiled spring 41.

Thus, when the carriage body 5 is shifted toward the left in a state where the print head 8 is disposed in the printing position, the release lever 35 is held in the position shown in FIG. 4, so that the third intermediate gear 38 is separated from the first intermediate gear 34 and the driven gear 19 is disengaged from the operation of the driving gear 33.

In the conventional printing apparatus, the coiled spring 41 is not provided, so that when the carriage body 5 is moved toward the left when the print head 8 is disposed at a printing position, the clockwise rotational power of the driving gear 33 is transmitted to the spool shaft 17 through the first, second, and third intermediate gears 34, 37, and 38. The driven gear 19 applies to the spool shaft 17 a rotational force opposite to the direction for winding the ribbon. The application of such a rotational force to the spool shaft 17 causes the unidirectional clutch spring 20 to be wound too tight. This causes a large load against the movement of the carriage body 5 toward the left and generates noise by the engagement between the first and third intermediate gears 34 and 38.

On the other hand, in this embodiment, since the coiled spring 41 is provided, when the carriage body 5 is moved toward the left, the third intermediate gear 38 is separated from the first intermediate gear 34 due to the above mentioned function of the coiled spring 41, thereby separating the third intermediate gear 38 from the first intermediate gear 34. There is no possibility of generating noise between the first and third intermediate gears 34 and 38 nor of applying to the ribbon winding spool shaft 17 a rotational force in a direction opposite to the direction for winding the ribbon. The carriage body 5 may be moved toward the left smoothly.

In this embodiment, the releasing lever 35 acts as a first releasing means and the coiled spring 41 acts as a second releasing means and they are disposed in proximity to each other so as to be operatively interlinked to each other. The space for disposing the first and second releasing means can be made small and the constructions thereof can be simplified.

Accordingly, in this embodiment a character printing operation in one direction can be performed with a thermal printing head and a thermal transferable ribbon. Back and forth character printing operations can be performed by using thermal sensitive printing paper and the thermal printing head. Further, in the printing operation in the reverse direction using the thermal sensitive printing paper, no noise is generated from the engagement of the intermediate gears and the carriage body may be moved smoothly.

Next, explanation will be made of the constructions and the operations thereof for preventing slack in the ribbon when the carriage body 5 is shifted to the print start position after completion of the printing operation of one line.

In case of feeding a new printing paper P into the printing apparatus or spacing to the next line to be printed, the carriage body 5 is shifted to the print start position and the release lever 10 is disposed in the position shown by the chain line in FIG. 2. Thus, the print head 8 is shifted from a printing position shown by the solid line in FIG. 2 to a non-printing position shown by the chain line in FIG. 2 together with the head carriage 7 by the force of the tension spring 12. This rotational movement of the print head 8 results in slack in the thermal transferable ribbon R as described above. At the same time, the leaf spring 31 is bent toward the guide wall 30 by a counteracting force thereof since the ribbon R is loose. The leaf spring 31 is consequently displaced to a position shown in FIG. 4 to eliminate slack in the ribbon R.

Figure 6:
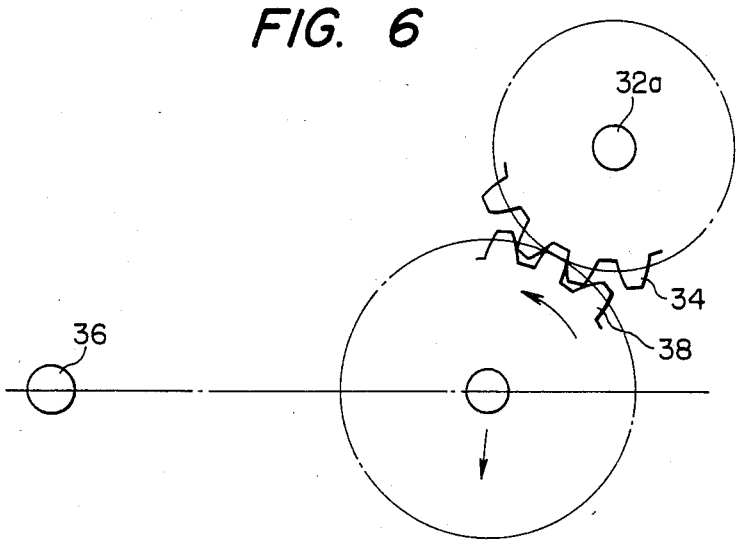
FIG. 6 is an enlarged plan view showing a pair of gears in an engaged relation.

Further, by the rotational movement of the print head 8, the slant surface 11*a* of the projection tab 11 engages with engaging portion 39 of the release lever 35 to move the release lever 35 from the position shown in FIG. 3 to the position shown in FIG. 4 against the force of the tension spring 40. In this case, since the teeth of the first intermediate gear 34 are disposed on a moving locus with the teeth of the third intermediate gear 38 and since the rotational movement of the print head 8 to a non-printing position is performed when the rotation of the driving gear 33 and the first intermediate gear 34 is prevented and the print head 8 is fixed on the carriage body 5, the third intermediate gear 38 is rotated counterclockwise in FIG. 6 by the clockwise rotation of the release lever 35 in FIG. 3 when the teeth of the third intermediate gear 38 separate from the teeth of the first intermediate gear 34. Due to the rotation of the third intermediate gear 38, the spool shaft 17, interlinking the cylindrical member 18 and the ribbon winding spool 28 are rotated by a given angle in the direction for winding the ribbon through the second intermediate gear 37 and the driven gear 19, thereby winding the thermal transfer ribbon R. Further, after the counterclockwise rotation of the third intermediate gear 38 in FIG. 6 resulting from the rotational movement of the release lever 35, the third intermediate gear 38 is completely separated from the first intermediate gear 34 to release the operational interconnection between the driving gear 33 and the driven gear 19.

As described above, in this embodiment, when the print head 8 is moved to a non-printing position, the printed portion of the thermal transferable ribbon R is wound by a predetermined length, so that the used portion of the ribbon is prevented from being used again when the print head is again disposed in the printing position and the printing operation is restarted.

Another embodiment of the present invention for preventing slack in the ribbon will be explained referring to FIG. 7. This embodiment further includes, in addition to the elements of the above-described embodiment, a ratchet wheel 50 mounted on the shaft 36 above the second intermediate gear 37 so as to rotate with the second intermediate 37. A supporting tab 51 is provided on the release lever 35 between the shaft 36 and the engaging portion 39 such that one end thereof is clamped to the release lever 35 through a pair of screws 52. A ratchet 53 is rotatably supported to the other end of the supporting tab 51. A spring 54 is wound around a center portion of one of the screws 52 so that one end is fixed to the ratchet 53 and the other end is fixed to the supporting tab 51. The ratchet 53 is biased by the spring 54 to engage a tooth of the ratchet wheel 50.

Figure 7:
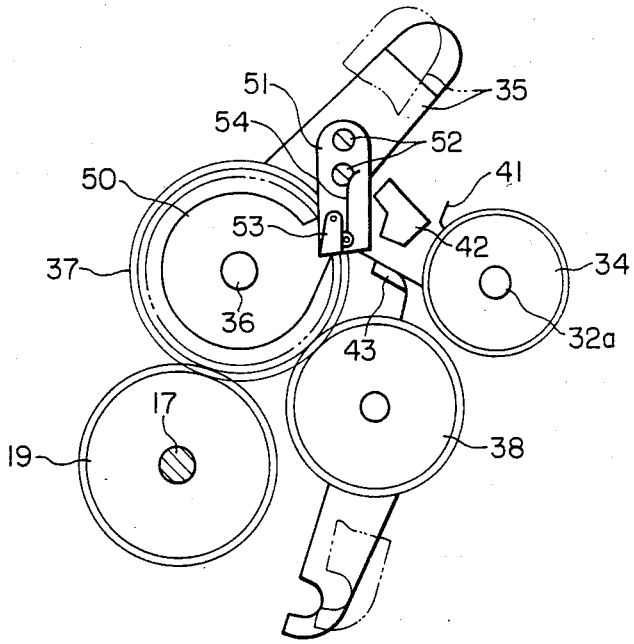
FIG. 7 is a plan view showing a main part of another embodiment of the present invention.

In this construction, when the release lever 35 is rotated from a position shown by the chain line to a position shown by the solid line as shown in FIG. 7 in response to the movement of the print head 8 from a printing position to a non-printing position, the ratchet 53 on the supporting tab 51 is engaged with the tooth of the ratchet wheel 50 thereby rotating the ratchet wheel 50 clockwise in FIG. 7 by a predetermined angle. Thus, the rotational movement of the ratchet wheel 50 is transmitted to the driven gear 19 through the second intermediate gear 37 which rotates with the ratchet wheel 50, so that the spool shaft 17 is rotated by a given angle to wind the used portion of the thermal transferable ribbon R around the ribbon winding spool 18.

Thus, in this embodiment, in response to the movement of the head carriage 7 to a non-printing position, the used portion of the thermal transferable ribbon R can be wound up to prevent it from being reused when restarting the printing operation.

It should be understood that the present invention is not limited to the description above but is subject to modifications, alterations, and equivalent arrangements within the scope of the appended claims.

What is claimed is:

1. A printing apparatus comprising:

a platen;

a carriage movable in forward and reverse directions along said platen;

a print head mounted on said carriage so as to be movable relative to said carriage between a printing position and a non-printing position;

a ribbon cassette detachably mounted on said carriage, said ribbon cassette including a ribbon spool;

a spool shaft mounted on said carriage and being engageable with said ribbon spool to rotate the same;

a driving gear mounted on said carriage and being rotated in accordance with the movement of said carriage;

a driven gear mounted on said carriage and being connected to said spool shaft to rotate the latter;

and a rotation transmitting mechanism adapted to operatively connect said driving and driven gears, operative connection between said driving and driven gears being released by the movement of said print head against said rotation transmitting mechanism as said print head moves to its non-printing position, and said driven gear being rotated in ribbon winding direction by a predetermined angle in response to the movement of said print head from its printing position to its non-printing position so that a used portion of said ribbon is prevented from being used again.

2. A printing apparatus comprising:

a carriage movable in a forward direction and a reverse direction;

a print head mounted on said carriage so as to be movable between a printing position and a non-printing position;

a ribbon cassette detachably mounted on said carriage, said ribbon cassette including a ribbon feed spool, a ribbon wind spool, and a ribbon connected between said ribbon feed spool and said ribbon wind spool;

a driving gear mounted on said carriage and being rotated in accordance with the movement of said carriage in said forward direction and said reverse direction;

a spool shaft mounted on said carriage and rotatable in one direction for rotating said ribbon wind spool; and a rotation transmitting mechanism having first and second releasing means provided on said carriage between said driving gear and said spool shaft for operatively interlinking said driving gear and said spool shaft so as to rotate said spool shaft in said one direction in accordance with the movement of said carriage to said forward direction, said first releasing means being driven by said print head to release said operational interlink between said driving gear and said spool shaft when said print head is disposed in said non-printing position, and said second releasing means for releasing the operational interlink between said driving gear and said spool shaft in accordance with the movement of said carriage in said reverse direction wherein said first release means includes a releasing lever mounted on said carriage to be movable between a first and second position and an intermediate gear member engageable with said driving gear and said spool shaft, said driving gear being operatively connected with said spool shaft through said intermediate gear member when said releasing lever is in said first positon and being disconnected from said intermediate gear member when said releasing lever is in said second position, said releasing lever being disposed at said first and second positions when said head is disposed at said printing and non-printing positions, respectively; and a surface associated with said print head for engaging one end of said releasing lever when said head is disposed at said non-printing position to move said release lever from said first position to said second position.

3. A printing apparatus according to claim 2, further including a tension spring connected to another end of said releasing lever for biasing said releasing lever into said first position, said releasing lever being displaced from said first position to said second position against the bias of said tension spring when said head is moved to said non-printing position.

4. A printing apparatus according to claim 2, wherein said second releasing means comprises a spring having one end engaged with said releasing lever to move said releasing lever to said second position when said carriage is moved in said reverse direction.

5. A printing apparatus according to claim 2 wherein during movement of said print head from said printing position to said non-printing position slack is introduced into said ribbon and wherein said apparatus includes means for removing said slack from said ribbon in response to movement of said print head.

6. A printing apparatus according to claim 5, wherein said removing means comprises means for rotating said spool shaft to wind up said slack in said ribbon responsive to movement of said releasing lever from said first position to said second position.

7. A printing apparatus according to claim 6, wherein said rotating means comprises:

a ratchet member provided on said releasing lever; and a ratchet wheel rotatably mounted on said releasing lever between said intermediate gear member and said spool shaft and being engaged with said intermediate gear and said spool shaft, said ratchet member being engaged with said ratchet wheel to rotate said ratchet wheel slightly responsive to movement of said releasing lever to said second position.

8. A printing apparatus according to claim 5, further including a ribbon wind spring for applying a force to said ribbon wind spool to resist rotation of said ribbon wind spool in a direction that would unwind said ribbon from said ribbon wind spool.

9. A printing apparatus according to claim 8, wherein said removing means comprises a ribbon bias spring having a first end mounted to said ribbon cartridge and a second end in contact with said ribbon to apply a force to said ribbon in a direction to unwind said ribbon from said ribbon wind spool, said force of said ribbon bias spring being less than said ribbon wind spring such that said ribbon is not unwound from said ribbon wind spool but said slack in said ribbon is removed by displacement of said ribbon by said ribbon bias spring.

* * * * *